US005197378A

United States Patent [19]

Scalise

[11] Patent Number: 5,197,378

[45] Date of Patent: Mar. 30, 1993

[54] PIZZA SCREEN OR PAN RECEIVING AND HOLDING ASSEMBLY

[76] Inventor: Guy G. Scalise, 22 Oakland Sq., Pittsburgh, Pa. 15213

[21] Appl. No.: 941,728

[22] Filed: Sep. 8, 1992

[51] Int. Cl.[5] ..... A47J 37/00

[52] U.S. Cl. ..... 99/357; 99/386; 99/443 C; 99/450; 126/19 R; 126/39 C; 126/273 R; 126/21 R; 312/236

[58] Field of Search ..... 99/339, 340, 357, 373, 99/386, 443 C, 448, 450, 484; 126/19 R, 19 M, 21 A, 37 B, 39 B, 4, 55, 39 C, 218, 273 R, 505, 554, 555; 312/236, 237; 219/388; 432/92, 261

[56] References Cited

U.S. PATENT DOCUMENTS

| | | | |
|---|---|---|---|
| 187,744 | 2/1877 | Yourtee | 126/55 |
| 273,730 | 3/1883 | Harlow | 126/55 |
| 957,748 | 5/1910 | Coppridge | 126/273 R |
| 1,670,020 | 5/1928 | Chalmers | 312/236 |
| 3,096,707 | 7/1963 | Mills | 99/425 |
| 3,327,616 | 6/1967 | Ozymy | 99/357 |
| 3,663,081 | 5/1972 | Williams | 312/236 |
| 4,506,652 | 3/1985 | Baker et al. | 219/388 |
| 4,591,333 | 5/1986 | Henke | 99/443 C |
| 4,877,011 | 10/1989 | Willice | 126/21 A |
| 4,919,109 | 4/1990 | Riley | 126/19 R |

*Primary Examiner*—Timothy F. Simone
*Attorney, Agent, or Firm*—Paul Bogdon; Nancy M. Scalise

[57] ABSTRACT

A pizza screen or pan receiving and holding assembly for use in combination with a pizza baking oven is disclosed. The assembly includes a main frame formed of side and end rails interconnected in a generally rectangular pattern with casters provided at the four corners to position the main frame in the open space beneath the baking sections of pizza baking oven. Cross members extend laterally of the side rails to define an open lattice for receiving pizza baking screens or baking pans. Upright members extend upwardly from the front and rear sides of the main frame. A box support frame of a generally rectangular shape formed of interconnected side and end shaft members is secured to the upright members and is inclined rearwardly downwardly. A plurality of boxes sized to receive different dimensioned pizza screens or pans are removably received on the box support frame. The boxes have opened front ends and closed rear ends. The entire assembly is positioned beneath the lowermost baking section of a pizza oven in a location where pizza screens or pans may be deposited in the boxes or on the main frame.

10 Claims, 3 Drawing Sheets

PIZZA SCREEN OR PAN RECEIVING AND HOLDING ASSEMBLY

BACKGROUND OF THE INVENTION

This invention relates to a pizza baking screen or baking pan receiving and holding assembly for use with standard pizza baking ovens having one or more baking sections elevated above ground level by a support structure. The assembly of this invention is positioned beneath the lowermost pizza baking section at a location for receiving and holding hot pizza baking screens or pans after baked pizzas are removed from the ovens.

Commercial establishments known commonly as pizzerias bake pizzas in standard pizza ovens which have one or more baking sections having an open space between the lowermost baking sections and the floor level. Pizzas to be baked are placed on baking screens or into baking pans and put into the ovens until completely baked. Long stemmed paddles are used to insert and remove the pizzas in their baking screens or pans into and from the ovens. The baked pizzas are removed from the screens or pans and deposited onto serving trays or into take out boxes. The hot screens or pans are then deposited either into open cardboard boxes disposed beneath the baking sections of the ovens or thrown on the floor. Oftentimes the hot screens or pans miss their boxes and end up somewhere beneath the ovens. Typically there is no order to the storage of the hot screens and pans. Whenever screens or pans are needed from the supply of the hot screens and pans someone is required to retrieve them from the cardboard boxes or from the floor beneath the ovens. This retrieval process is time consuming and sometimes hazardous, especially when the screens or pans are well beneath the ovens and out of ready reach. The disorderly storage of the hot screens and pans is not only unsightly but may result in screens and pans getting under the feet of workers where they are compelled to use valuable time to move the screens and pans out of interference with their movement. More significantly the disordered screens and pans may cause workers to trip and fall resulting in injuries.

No known system or assembly has been heretofore offered to receive and store hot pizza baking screens and pans. Consequently pizzerias have continued to exist with the disorderly and oftentimes hazardous method of strewing hot pizza baking screens and pans beneath the pizza ovens.

This invention overcomes the heretofore problems of storing hot pizza baking screens and pans by providing a compact and efficiently formed pizza screen or pan receiving and holding assembly which is simply positioned in the open space beneath the lowermost baking section of most standard pizza baking ovens. Pizza screen receiving boxes of different sizes for receiving small, medium, and large pizza screens are supported for easy deposit of the hot screens after the baked pizzas are removed onto trays or take out containers. Pizza pans may be deposited on a main frame used to support another frame for receiving the pizza screen boxes. The entire assembly is simply and effectively positioned with respect to the pizza oven. The pizza screen box supporting frame may be removable from the main frame and secured to the support structure of the pizza oven whereby the pizza screen receiving boxes are disposed for receiving the hot pizza baking screens. The overall structure of the assembly of this invention is simple in its construction, easy to handle, efficient in its use, and relatively inexpensive to produce. In addition to providing for orderly storage and retrieval of hot pizza screens and pans this invention allows for effective cooling of the screens and pans.

SUMMARY OF THE INVENTION

This invention provides a pizza screen or pan receiving and holding assembly, for use in combination with a pizza baking oven having one or more baking sections and a support structure elevating the baking sections above floor level and providing open space between the lowermost baking section and floor level. Typically the assembly is arranged in the open space below the baking sections and located to receive hot pizza screens or pans after the pizza is done baking. The assembly of this invention preferably comprises: a main frame formed of side and end rails interconnected in a generally rectangular pattern, and a plurality of spaced cross members extending laterally of the side rails to define an open lattice sized and shaped to receive and hold pizza baking screens or pizza baking pans; upright members extending upwardly from the front side of the main frame and at substantially right angles thereto; a box supporting frame formed of side and end shaft members interconnected in a generally rectangular pattern to form a box-supporting surface having the forward sections of the end shaft members secured to upper end sections of the upright members and the rear side shaft member engaged by the rear end of the main frame or supported by rear upright members secured at the rear side of the main frame whereby the box-supporting surface is inclined rearwardly and downwardly; a plurality of pizza screen receiving boxes removably received on the box-supporting surface of the box support frame, the boxes having open forward ends and closed sides and rearward ends; the main frame, box support frame, and pizza screen receiving boxes being sized and shaped such that the entire assembly is received in the open space beneath the baking sections of the pizza oven in a position to have pizza screen deposited into the boxes; and positioning means for positioning the main frame in the open space beneath the lowermost section of the pizza oven. The front upright members may be pivotally secured on the side shaft members of the box support frame, and provided with clamps for grasping portions of the support structure of the pizza oven. In addition the box support frame may be removable from the main frame whereby the box support frame with pizza screen receiving box thereon may be secured through the front upright members or separate support members clamped to the support structure of the oven in a rearwardly and downwardly inclined Position similar to the position it realizes on the main frame. Either supported by this main frame or directly by the pizza oven, the pizza screen receiving boxes are disposed to receive hot pizza screens upon completion of baking of the pizza. The boxes may be alternately sized to receive small, medium, and large pizza baking screens. Also, the boxes may be provided with openings in two or more of their sides or formed of grate sections to allow cooling air to circulate about the hot screens. When screens are needed, one or all of the screen laden boxes may be removed from the box support frame, the screens removed in an orderly fashion, and the empty box or boxes returned to the box support frame for receiving additional baking screens.

Various other advantages, details, and modifications of the present invention will become apparent as the following description of a certain present preferred embodiment proceeds.

DESCRIPTION OF THE DRAWINGS

In the accompanying drawings, I show a certain present preferred embodiment of the invention in which.

DESCRIPTION OF A PREFERRED EMBODIMENT

Figure 1:
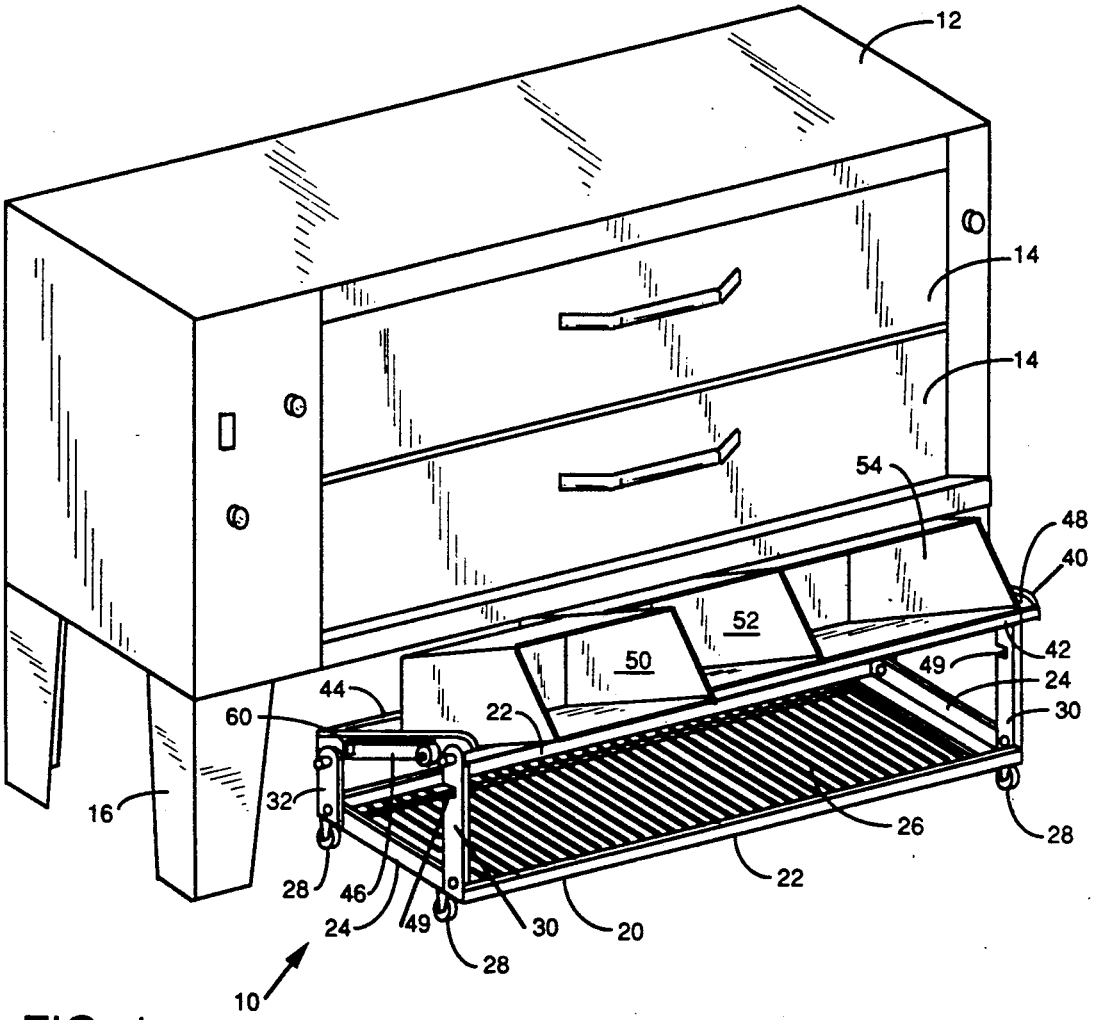
FIG. 1 is a perspective view of a pizza screen or pan receiving and holding assembly embodying one form of the present invention, showing the assembly disposed on the floor in the open space beneath a pizza oven.
Figure 2:
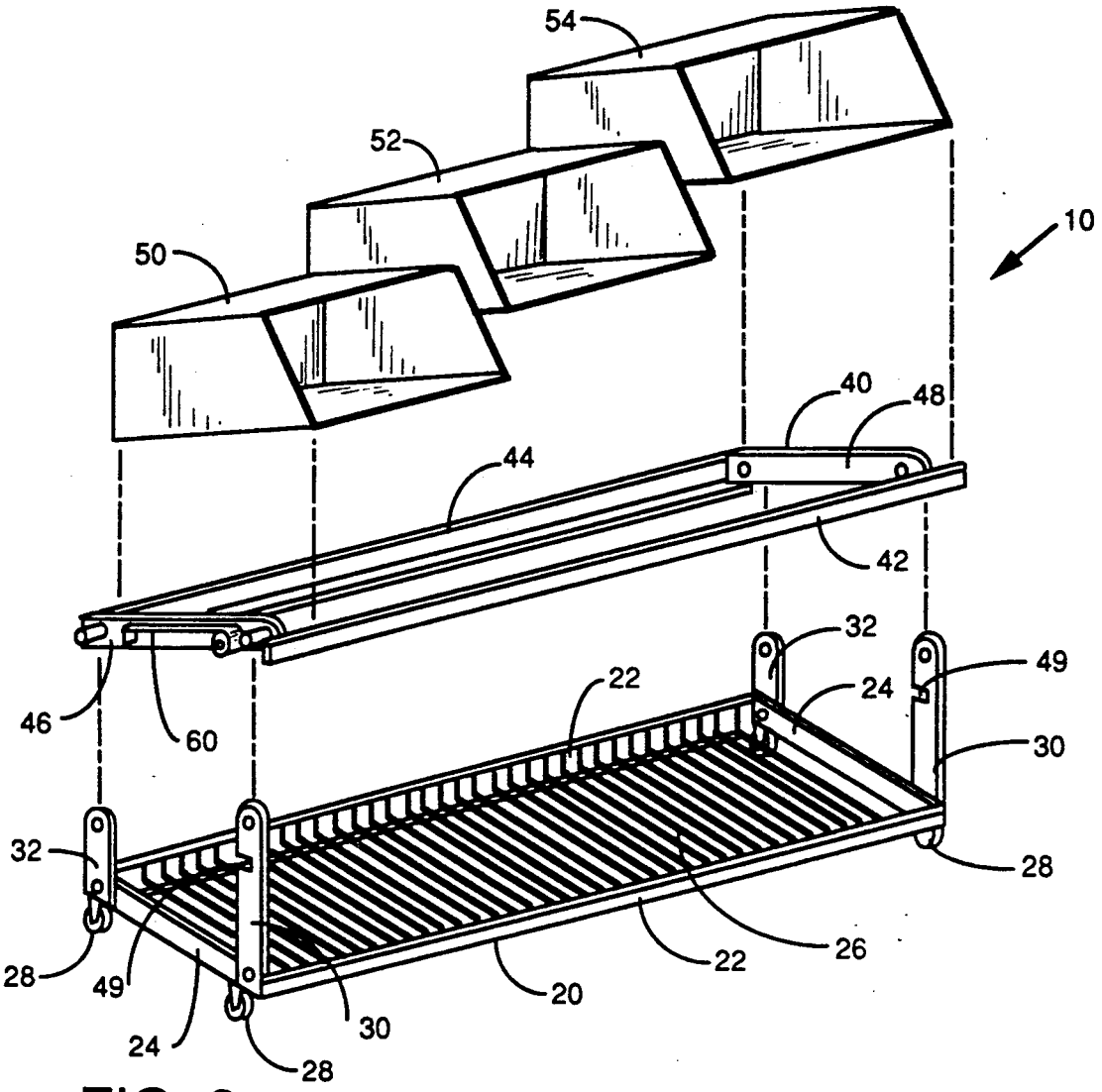
FIG. 2 is a perspective of the assembly or FIG. 1 showing the elements detached from each other.
Figure 3:
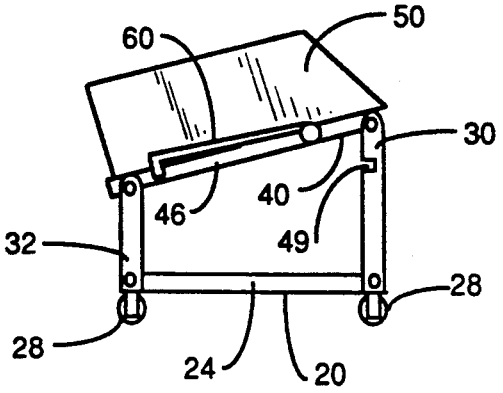
FIG. 3 is a side elevation view of the assembly of FIG. 1.

Referring now to the drawings there is shown a pizza screen or pan receiving and holding assembly 10 embodying the present invention and arranged for use with a standard pizza baking oven 12 having two pizza baking sections 14 elevated above floor level by a support structure 18. As shown, and typically with standard pizza ovens, the support structure 18 of the oven 12 defines an open space between the lowermost baking section 14 and the floor level. The assembly 10 is sized and shaped to fit conveniently in the open space as shown in the drawings. The assembly 10 includes a main frame 20 formed of generally parallel elongated side L-shaped rails 22 and interconnected parallel similarly shaped end rails 24 forming a generally rectangular pattern. A grate 28 formed of parallel cross members is arranged laterally of the side rails 22, and may be removable as a single unit from the main frame 20. The grate 28 together with the main frame 20 defines an open lattice and is sized to receive either pizza baking screens or pizza baking pans. The main frame 20 is provided with wheels or casters 28 suitably secured to the lower corners of the main frame, to allow for ease of movement of the main frame into position beneath the pizza oven 12, as shown.

Secured to the forward or front ends of end rails 24 of the main frame 20 are generally parallel vertically upwardly extending front upright members 30 which may be secured in place by nuts and bolts, or any like fastening means. Similar to front upright members 30, but shorter in length, generally parallel vertically extending rear upright members 32 are secured to the rearward ends of the end rails 24. Removably secured to the upper ends of the upright members 30 and 32 is a box support frame 40 formed of parallel front and rear side shafts 42 and 44 interconnected with parallel end shafts 46 and 48 to form a rectangular pattern. The upper ends of the upright members 30 and 32 are secured to the forward and rearward end sections of the end shafts 40 and 48 by any suitable attachment means, such as nuts and bolts or merely arranged on cylindrical studs. By being attached to the upright members 30 and 32 the box support frame 40 is inclined rearwardly and downwardly, as shown. The side shafts 42 and 44 and end shafts 46 and 48 are formed from L-shaped angle members and thereby together form a box-supporting surface for receiving, supporting, and holding removable boxes, as will be subsequently described. The respective lengths of the front and rear upright members 30 and 32 may be selected to provide a desired angle or inclination of the box support frame 40. The inclination angle may also be adjusted by providing a lateral slot 49 in each front upright support members 30 and securing the front of the box support frame 40 in the slots 49. The open space beneath the oven 12 would also be a factor in determining the angle of inclination of the box support frame 40 and coincidentally the respective lengths of the front and rear upright members 30 and 32. In some applications only the front upright members 30 would be needed with the rear end of the box support frame 40 supported directly by the main frame 20 on the rear side rail 22.

As shown, three similarly shaped pizza screen receiving boxes 50, 52, and 54 are removably received on and supported by the box support frame 40. Each box 50, 52 and 54 has a rectangular cross-section, a closed rear end, and an open front end having an upwardly and rearwardly inclination relative to the box support frame 40. The boxes 50, 52, and 54 may be identically sized and shaped, or may be sized to receive and store pizza baking screens having the dimensions for small, medium, and large sized pizzas. The rear side member 44 of the box support frame 40 defines an upright L such that the boxes 50, 52 and 54 abut the rear side member 44 and are secured against rearward movement. The front side member 42 has a downward L allowing the boxes 50, 52 and 54 to be readily slid onto or off of the frame 40.

A shown in Figures, the entire pizza screen or pan receiving and holding assembly 10 is positioned in the open space beneath the lowermost baking section 14 of the oven 12, and is ready to receive in the boxes 50, 52, and 54, in an efficient fashion, hot pizza screens after baked pizzas are removed. Similarly, pizza baking pans may be deposited into the boxes, or onto the grate 26 on the main frame 20. Whenever pizza screens are needed any or all of the boxes 50, 52, and 54 may be simply removed from the box support frame 40 and transported to a work station or to a storage area.

Figure 6:
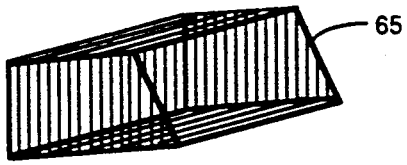
FIG. 6 is a perspective view of one pizza screen receiving box forming part of the present invention and showing another form of the pizza screen holding box.

As shown by box 65 in FIG. 6 the boxes 50, 52, and 54, or any of them, may be formed of grate sections, or may be provided with openings in any two or more of their sides for allowing air to circulate around the hot pizza screens to thereby facilitate cooling.

Figure 4:
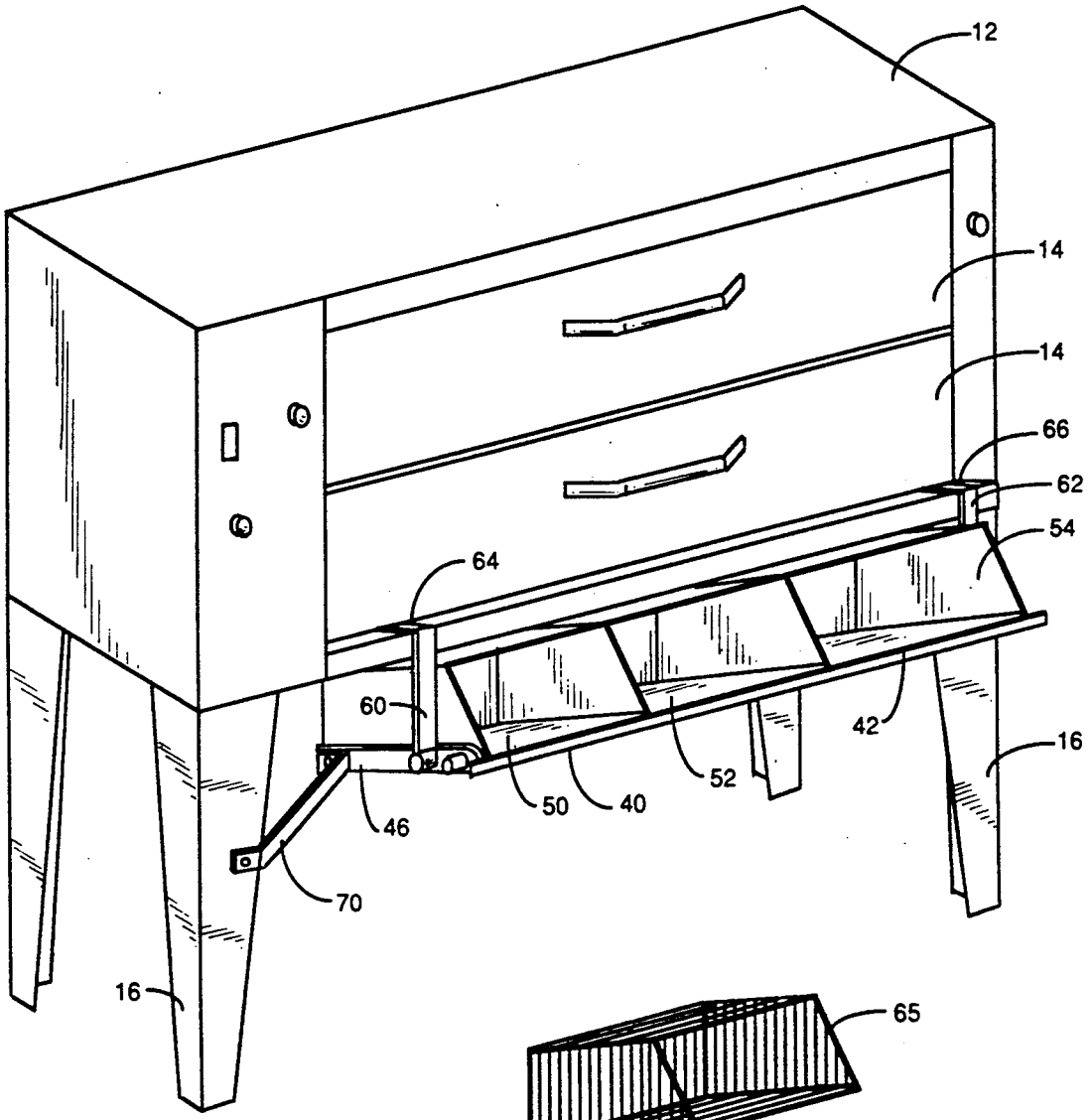
FIG. 4 is a perspective view of a pizza screen or pan receiving and holding assembly embodying another form of the present invention showing the assembly secured to the support structure of a pizza oven.

The box support frame 40 may be removed from the main frame 20 and, as shown in FIG. 4 secured directly at a downward and rearward inclination with respect to the support structure 10 of the oven 12. A pair of similarly shaped legs 60 and 62 are pivotally arranged at a forward section of the end shafts 46 and 48 of the box support frame 40. The legs 60 and 62 have an upper clamp 64 and 68, respectively, in the form of right angle portion sized to fit on the ledge of the support structure 16 of oven 12 and to extend partially between the ledge and the bottom of the door to the lowermost baking section 14 of the oven 12. The legs 60 and 62 may be secured in place after the box support frame 40 is positioned as desired with respect to the oven 12. As when the box support frame 40 is on the main frame 20, the boxes 50, 52 and 54 are simply emplaced, ready to receive hot pizza screens or pans.

Figure 5:
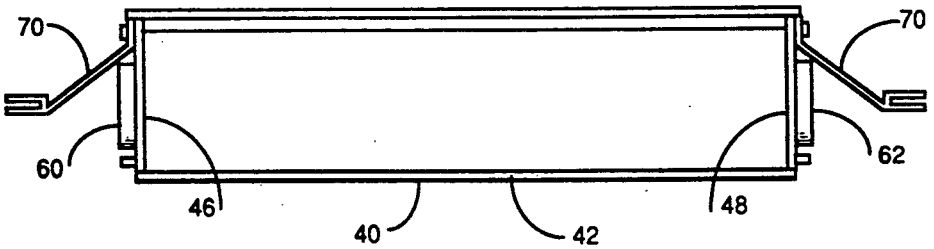
FIG. 5 is a plan view of the assembly of FIG. 4 without the pizza screen holding boxes thereon and disconnected from the pizza oven support structure.

In the arrangement of FIGS. 4 and 5, the box support frame 40 may use legs 60 and 62 as separate and distinct members for supporting the frame 40 on the oven 12, or the legs 60 and 62 may be the elements akin to the front upright members 30 which serve to support the box support frame 40 on the main frame 20. By varying the positions of the legs 60 and 62 on the end shafts 40 and 48, and similarly varying their lengths the box support frame 40 with the boxes 50, 52, and 54 thereon may be accommodated to particular oven designs. Also, in legs 60 and 62 may be provided with clamping means suitable to particular support structures of different oven designs. Additional support for securing the box support frame 40 to the support structure 16 of the oven 12 may be provided by one or two rods 70 having one end secured as by a bolt and nut to the rear end of the end shafts 40 and 48 of the frame 40 and the other end clamped to the legs of the support structure 16, as shown.

It should now be clearly recognized how the advantages of this invention as stated in the introductory sections of this specification are achieved. Hot pizza baking screens and/or pans are received and stored in an efficient manner by an assembly which is compact and simply structured. It should be further recognized that this invention by its simple and efficient form may be easily stored, effectively used, readily cleaned and maintained. Various changes and modifications to the makeup of this invention should be readily apparent to those skilled in this art.

While I have shown and described a present preferred embodiment of this invention, it is to be distinctly understood that the invention is not limited thereto, but may be otherwise embodied within the scope of the following claims.

I claim:

1. In combination with a pizza baking oven having one or more baking sections and a support structure elevating the baking sections above floor level and providing open space between the lowermost baking section and floor level, a pizza screen or pan receiving and holding assembly, comprising:

a main frame formed of side and end rails interconnected in a generally rectangular pattern;

upright members extending upwardly from the front side of said main frame and at substantially right angles thereto;

a box support frame formed of side and end shaft members interconnected in a generally rectangular pattern to form a box-supporting surface having the forward sections of the end shaft members secured to upper end sections of said upright members and the rear side shaft member engaged by the rear end rail of said main frame whereby said box-supporting surface is inclined rearwardly and downwardly;

a plurality of pizza screen receiving boxes removably received on the box-supporting surface of said box support frame, said boxes having open forward ends and closed rearward ends;

said main frame, box support frame and pizza screen receiving boxes being sized and shaped such that the entire assembly is received in the open space beneath the baking sections of a pizza baking oven in position to have pizza screens deposited into said pizza screen receiving boxes; and positioning means for positioning said main frame beneath the lowermost baking section of a pizza baking oven in a location for said pizza screen receiving boxes to have pizza screens deposited therein.

2. The pizza screen or pan receiving and holding assembly as set forth in claim 1 wherein said positioning means includes caster assemblies secured at the four corners of said main frame to either the side or end rails.

3. The pizza screen or pan receiving and holding assembly as set forth in claim 1 including a grate section supported by said main frame within the confines of said side and end rails formed of a plurality of spaced cross members extending laterally of the side rails to define an open lattice sized and shaped to receive and hold pizza baking screens or pizza baking pans.

4. The pizza screen or pan receiving and holding assembly as set forth in claim 1 wherein said box support frame is removable from said main frame; said upright members are pivotally connected at their upper ends to forward sections of said end shaft members of said box support frame; said positioning means includes clamping members on the lower ends of said upright members sized and shaped to secure said upright members to the support structure of a pizza baking oven; said upright members and said clamping members sized, shaped and positioned such that when said upright members are secured to the support structure of a pizza baking oven said box support frame is inclined rearwardly and downwardly at a position beneath the lowermost baking section of a pizza oven with said pizza screen receiving boxes in position to have pizza screens deposited therein.

5. The pizza screen or pan receiving and holding assembly as set forth in claim 1 wherein said pizza screen receiving boxes have their open ends inclined rearwardly and upwardly of said box support frame.

6. The pizza screen or pan receiving and holding assembly as set forth in claim 1 wherein at least two of the walls defining said pizza screen receiving boxes are provided with openings to allow air circulation through said boxes.

7. In combination with a pizza baking oven having one or more baking sections and a support structure elevating the baking sections above ground level and providing open space between the lowermost baking section and a floor level, a pizza screen or pan receiving and holding assembly, comprising:

a box support frame formed of side and end shaft members interconnected in a generally rectangular pattern to form a box-supporting surface;

a plurality of pizza screen receiving boxes removably received on the box-supporting surface of said box support frame, said boxes having open forward ends and closed rearward ends; and positioning means for positioning and securing said box support frame to the support structure of a pizza baking oven beneath the lowermost baking section thereof in a position inclined rearwardly and downwardly such that said pizza screen receiving boxes are located to have pizza screens deposited therein.

8. The pizza screen or pan receiving and holding assembly as set forth in claim 7 wherein said positioning means includes a pair of identical rod members, one each secured to a said end shaft of said box support frame, and clamping means on the free ends of said rod members for securing said rod members to the support structure of a pizza baking oven.

9. The pizza screen or pan receiving and holding assembly as set forth in claim 7 wherein said pizza screen receiving boxes have their open ends inclined rearwardly and upwardly of said box support frame.

10. The pizza screen or pan receiving and holding assembly as set forth in claim 7 wherein at least two of the walls defining said pizza screen receiving boxes are provided with openings to allow air circulation through said boxes.

* * * * *